United States Patent [19]

Kupfer et al.

[11] Patent Number: 4,768,962

[45] Date of Patent: Sep. 6, 1988

[54] FEED-THROUGH CONNECTOR FOR RF SIGNALS

[75] Inventors: Karl-Heinz O. Kupfer; Paul Friese, both of Krefeld, Fed. Rep. of Germany

[73] Assignee: U.S. Philips Corporation, New York, N.Y.

[21] Appl. No.: 51,545

[22] Filed: May 18, 1987

[30] Foreign Application Priority Data

May 17, 1986 [DE] Fed. Rep. of Germany ..... 3616734
May 17, 1986 [DE] Fed. Rep. of Germany ..... 3616760

[51] Int. Cl.[4] ..... H01R 17/04
[52] U.S. Cl. ..... 439/92; 439/675
[58] Field of Search ..... 439/92, 95, 101, 109, 439/578, 580, 581, 675

[56] References Cited

U.S. PATENT DOCUMENTS 2,970,287 1/1961 Gill ..... 439/92
3,879,103 4/1975 Peltola et al. ..... 439/581
4,136,918 1/1979 Claesson et al. ..... 439/172

*Primary Examiner*—Gil Weidenfeld
*Assistant Examiner*—Gary F. Paumen
*Attorney, Agent, or Firm*—David R. Treacy

[57] ABSTRACT

A feed-through connector which is mounted on an RF-shielding housing and which serves for the input and/or output of an RF signal. The feed-through connector comprises a grounded sleeve (122) and a signal conductor (112*a*) which is arranged in the sleeve. The conductor comprises a connection pin (112) which is accommodated in the sleeve so as to be insulated therefrom. The feed-through connector is divided into a connection base (101) which accommodates the conductor (112*a*) and which is secured to the housing (102), and a contact portion (103). In accordance with the desired connection standard, the contact portion (103) is provided with a connection pin (112) and a grounded sleeve (122) which is electrically insulated from the connection pin. The contact portion (103) electrically contacts the connection base (101).

7 Claims, 4 Drawing Sheets

FEED-THROUGH CONNECTOR FOR RF SIGNALS

BACKGROUND OF THE INVENTION

The invention relates to a feed-through connector which is arranged on an RF-shielding housing and which serves for the input and/or output of an RF signal. The feed-through connector comprises a grounded sleeve and a signal conductor with a contact pin which is arranged in the sleeve so as to be insulated therefrom.

Functional units comprising an RF circuit arrangement which is arranged inside the housing require at least one connector which is passed through the housing wall for the input and/or output of RF signals. Notably in the case of RF tuners at least one of these RF connections is generally an aerial connection socket. The outer, grounded portion of such RF connection socket is connected to the housing wall, for example by means of twist lugs, and is also soldered thereto.

A variety of standards exist for such connections, for example IEC, Phono-Jack or F-type. For known connection sockets this implies that for the manufacture of functional units the standard whereto the connection portions of the functional unit must adhere should be defined at an early stage. For different markets or different apparatus different types of tuners with different connection standards must be manufactured, because the connection sockets or connection portions cannot be exchanged and must match.

SUMMARY OF THE INVENTION

It is an object of the invention to provide a feed-through connector for functional units which can be flexibly adapted to the desired connection standard.

The feed-through connector in accordance with the invention is characterized in that it is divided into a connection base which accommodates the conductor and which is secured to the housing, and a contact portion which comprises, in accordance with a respective desired connection standard, a connection pin and a grounded sleeve which is electrically insulated therefrom, which contact portion electrically contacts the connection base.

The feed-through connector thus consists of two independent portions, that is a connection base which is secured to the housing of the functional unit and which is electrically connected to a circuit arrangement inside the functional unit, and the above-mentioned contact portion. The connection base is designed so that, when the contact portion is fitted thereon, electrical contact is made with the contact pin of the conductor which, in conjunction with the grounded sleeve, may comply with an arbitrary standard. During the manufacture of the functional unit, the connection base is secured to the housing and possibly soldered thereto. The manufacture of the functional unit has then been completed for the time being so that, for example, it can be stored. At a later stage, for example when such a functional unit is built into an apparatus, the connection standard to be satisfied by the connection of the functional unit must be defined. A contact portion which complies with the desired standard is then fitted on the connection base.

A single type of functional unit provided with the connection base can thus be manufactured. At that stage of manufacture the ultimate connection standard for the functional unit need not yet be specified. Stocking is thus simplified, because only one type of functional unit need be stocked. Already finished functional units can be flexibly adapted to the desired connection standard; this also holds good in the case of modification of connection standards.

In a further embodiment of the feed-through connector in accordance with the invention, the plastic connection base is provided with recesses and is secured to the housing by means of lugs which project from the housing and which engage the recesses. Because the connection base always remains on the functional unit, regardless of the desired connection standard, it can be permanently connected to the housing by means of these lugs and may also be soldered to the housing, if desired.

In a further embodiment of the feed-through connector in accordance with the invention, the contact portion extends over the connection base and comprises twist lugs which engage recesses in the housing.

In order to secure the contact portion to be fitted at a later stage, in a further embodiment in accordance with the invention a ring is clamped onto the contact portion, the edge of the ring which faces the housing being provided with teeth which engage corresponding counterparts of the housing. In conjunction with these counterparts, the teeth of the toothed ring prevent undesirable rotation of the contact portion. Thus, a connector plug cannot rotate the contact portion when it is inserted or removed.

Embodiments in accordance with the invention will be described in detail hereinafter with reference to the accompanying diagrammatic drawings.

DESCRIPTION OF THE PREFERRED EMBODIMENTS

Figure 1:
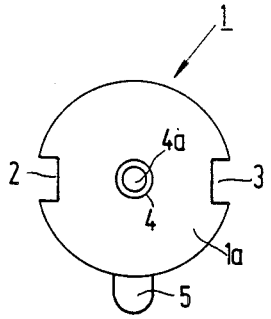
FIG. 1 is a plan view of a connection base.

FIG. 1 is a plan view of a first embodiment of a connection base 1 on which the contact portion shown in the FIGS. 5 to 8 can be fitted at a later stage. The connection base 1 comprises an approximately round plate 1*a* in which two oppositely situated, approximately rectangular recesses 2 and 3 are formed. These recesses 2 and 3 serve to accommodate at a later stage the lugs shown in FIG. 4. At its center the connection base 1 accommodates an electrical conductor 4 which leads to an electrical connection terminal 5 at the rear. The conductor 4 is constructed so as to be hollow at the area of the insulating plate 1*a*, and serves to contact a connection pin which is shown in FIG. 5 and which projects into the cavity 6. The connection terminal 5 serves to establish electrical contact with the circuit arrangement accommodated inside the functional unit. With the exception of the conductor 4 and the connection terminal 5, the connection base 1 is made of an insulating plastic.

Figure 2:
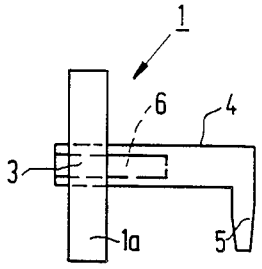
FIG. 2 is a side elevation of the connection base shown in FIG. 1.

FIG. 2 is a side elevation of the connection base shown in FIG. 1. It is clearly shown that the electrical conductor 4 is bent in the direction of the connection terminal 5.

Figure 3:
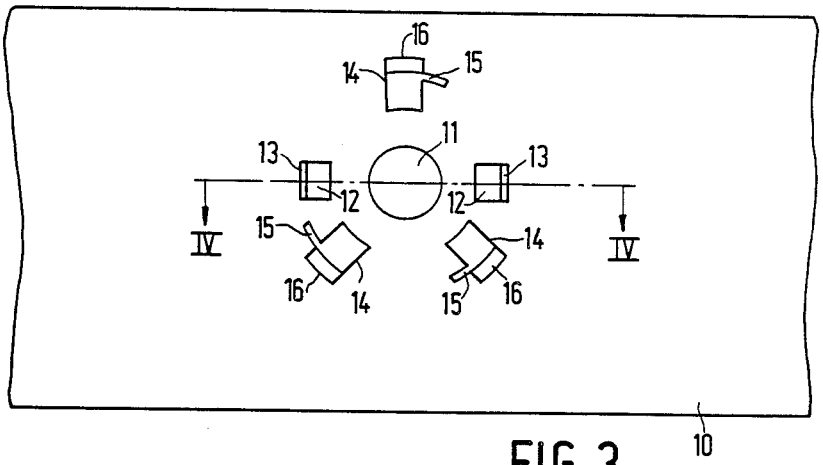
FIG. 3 shows a wall of the housing of a functional unit which has been prepared so as to receive an RF connector.

FIG. 3 shows a section of the wall 10 of the housing of a functional unit which is suitable for accommodating a connection base 1 as shown in FIG. 1. To this end, the wall 10 comprises a hole 11 whose diameter is larger than the diameter of the conductor 4. Further recesses 12 are provided in opposite locations on both sides of the hole 11. From these recesses 12 lugs 13 are bent so as to project from the wall 10 prior to the fitting of a connection base. These lugs 13 serve to secure the connection base 1. Three further recesses 14 are formed in a circular arrangement around the hole 11, i.e. at an angle of 120° with respect to one another. These recesses 14 comprise slit-shaped tails 15 which are engaged by twist lugs (not shown in the figure) of a contact portion 20 (FIG. 5). In addition to the recesses 14, lugs 16 for the positioning of the contact portion 20 project from the housing at a larger distance from the hole 11.

Figure 4:
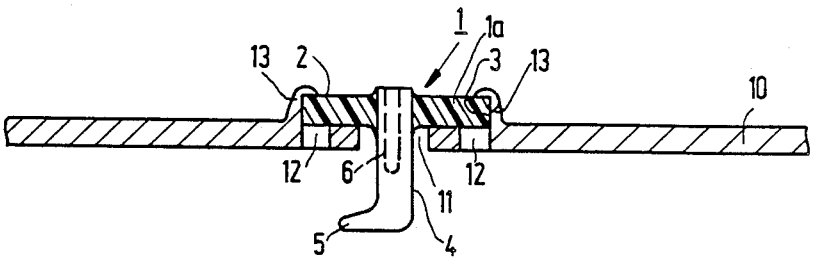
FIG. 4 is a sectional view, taken along the line IV—IV, of the housing wall shown in FIG. 3, fitted with a connection base as shown in the FIGS. 1 and 2 which forms one part of a first embodiment of a feed-through connector.
Figure 5:
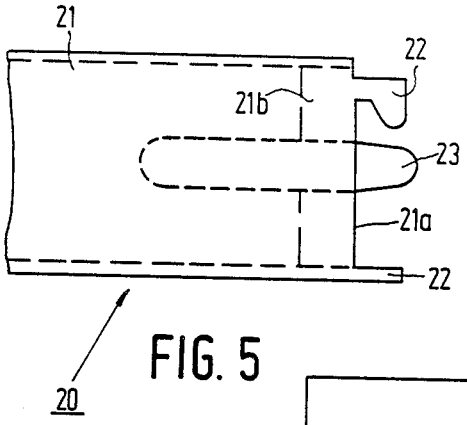
FIG. 5 is a side elevation of a contact portion which forms the other part of this feed-through connector.

FIG. 4 is a sectional view, taken along the line IV—IV, of the housing wall 10 shown in FIG. 3. The connection base 1 shown in the FIGS. 1 and 2 is mounted in the housing wall 10. The conductor 4 is passed through the hole 11 in the housing 10. The lugs 13 of the housing 10 extend along the recesses 2 and 3 of the connection base and over the plate 1*a*, so that the connection base 1 is firmly positioned on the wall 10.

Figure 6:
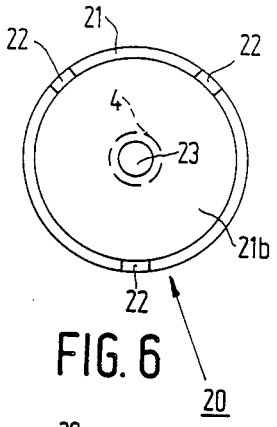
FIG. 6 shows the contact portion of FIG. 5, viewed on the side which is fitted on the housing.

A contact portion 20 as shown in the FIGS. 5 and 6 can be fitted on the connection base thus positioned.

FIG. 5 is a side elevation of the contact portion; this portion essentially consists of a metal, tubular sleeve 21, an edge 21*a* of which is provided with three twist lugs 22 which are distributed at angles of 120° along the edge 21*a*. At the area of the edge 21*a*, an insulating plate 21*b* is inserted into the sleeve 21, a connection pin 23 being passed through the center of the insulating plate. This connection pin 23 and the sleeve 21 form one portion of the feed-through connector which consists of two portions. The other portion is formed by the connection base 1. When the connection base 1 has been mounted on the wall 10 and the contact portion 20 is fitted on the wall 10 so that it extends over the connection base 1, the sleeve 21 contacts the wall 10 and the portion of the connection pin 23 which extends between the twist lugs 22 is inserted into and contacts the hollow conductor 4.

FIG. 6 is a plan view of the contact portion 20 which is shown in a side elevation in FIG. 5, i.e. viewed on the side provided with the twist lugs 22 and the connection pin 23. The distribution of the twist lugs 22 at angles of 120° is clearly shown. The connection pin 23 extends into the free inner space of the sleeve 21 where it serves as a contact pin for a connector (not shown) to be fitted, for example an aerial plug. The shape of the contact pin 23 and the shape of the sleeve 21 are determined by the desired connection standard. Thus, at the other side of the contact portion 21 an external plug is inserted.

Figure 7:
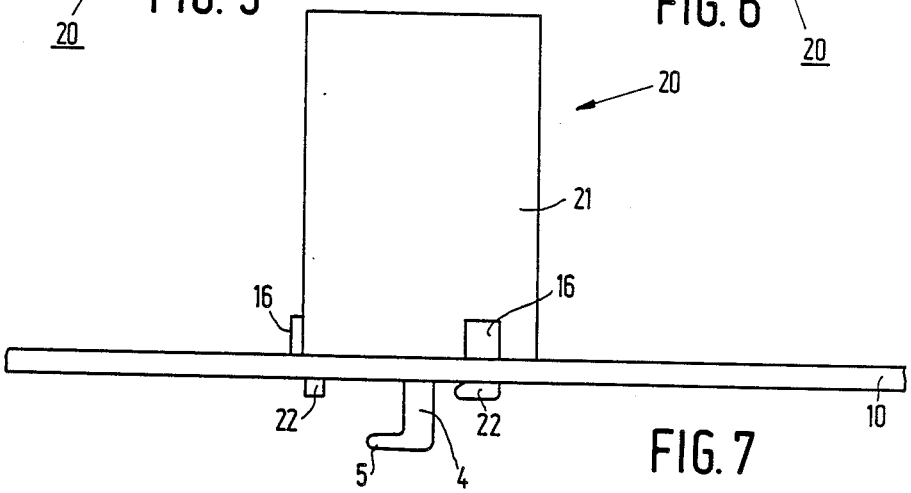
FIG. 7 shows the contact portion of FIGS. 5 and 6 which is fitted on a housing so as to extend over the connection base.

The contact portion 20 which is shown separately in FIGS. 5 and 6 is shown in the position fitted on the wall 10 in FIG. 7. The contact portion 20 is arranged between the lugs 16 of the housing wall 10. The twist lugs 22 of the contact portion 20 extend through the recesses 14 and are twisted in the slit-shaped tails 15, so that the twist lugs are clamped in the slits 15. In the condition shown in FIG. 7, i.e. with the fitted contact portion 20, the RF connector is ready for operation. Ground contact is improved by soldering. The connection pin 23 has been inserted into the cavity 6 of the conductor 4.

Figure 8:
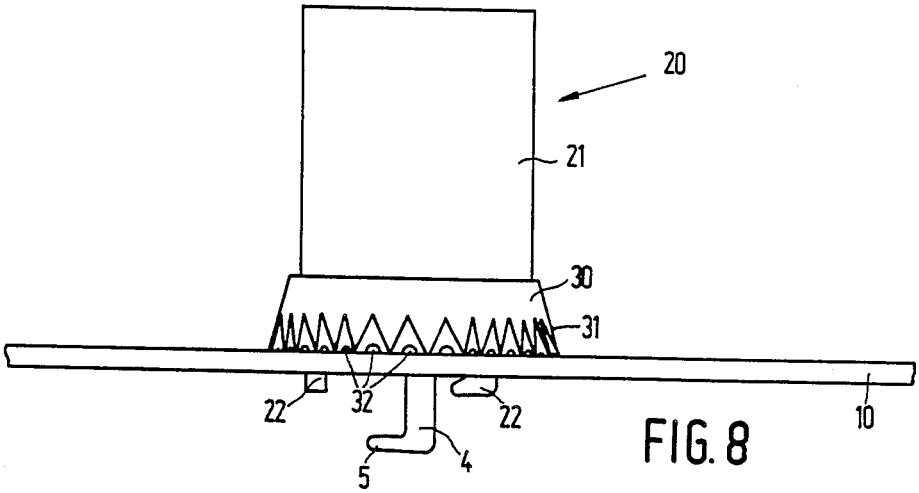
FIG. 8 is an elevation of a variation of the embodiment of FIG. 7 in which a toothed ring is provided on the contact portion.

FIG. 8 shows the wall 10 with the connection base 1 and the contact portion 20; however, the contact portion 20 is also provided with a flared ring 30 whose side which faces the housing comprises teeth 31. The teeth 31 engage associated counterparts 32 on the wall 10. Thus, unintentional rotation of the contact portion 20 is prevented. The ring 30 is preferably soldered to the sleeve 21.

Figure 9:
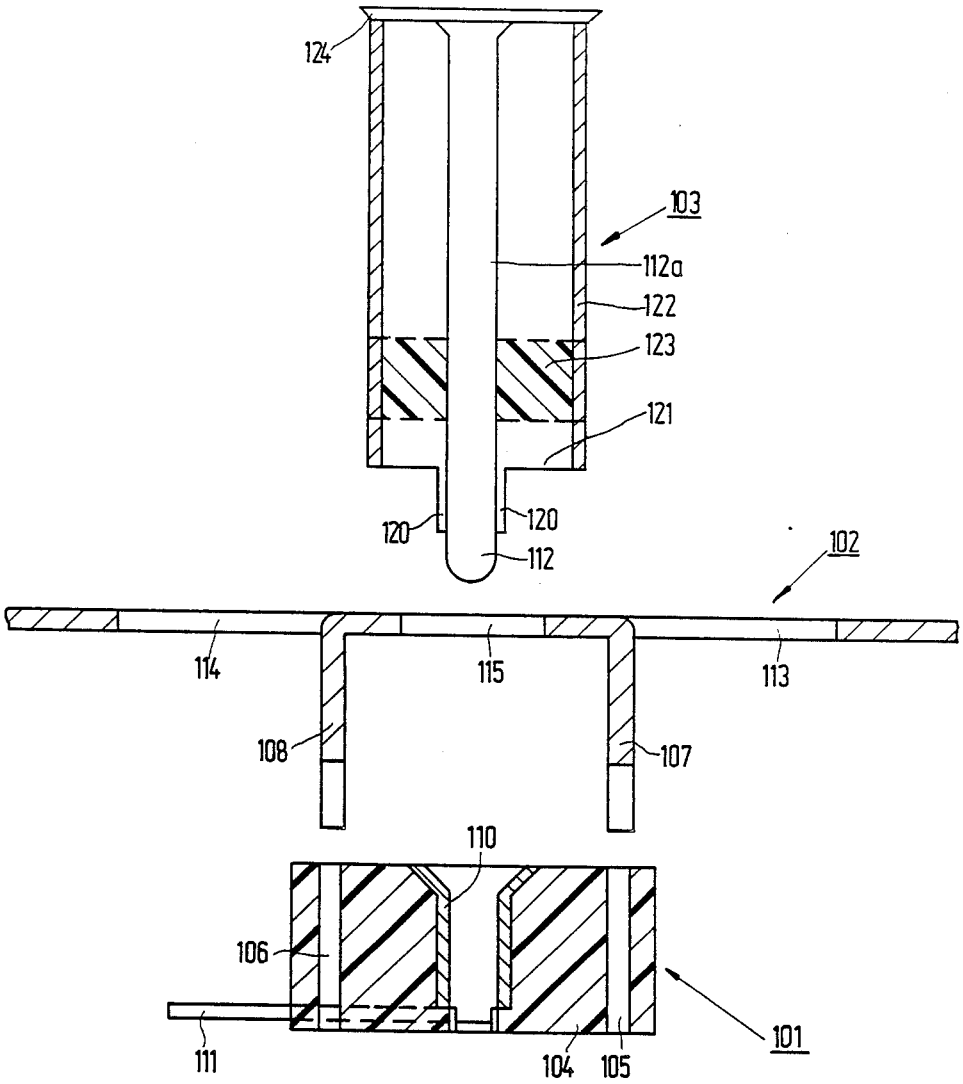
FIG. 9 is an exploded view of a housing wall and a second embodiment of a feed-through connector.
Figure 11:
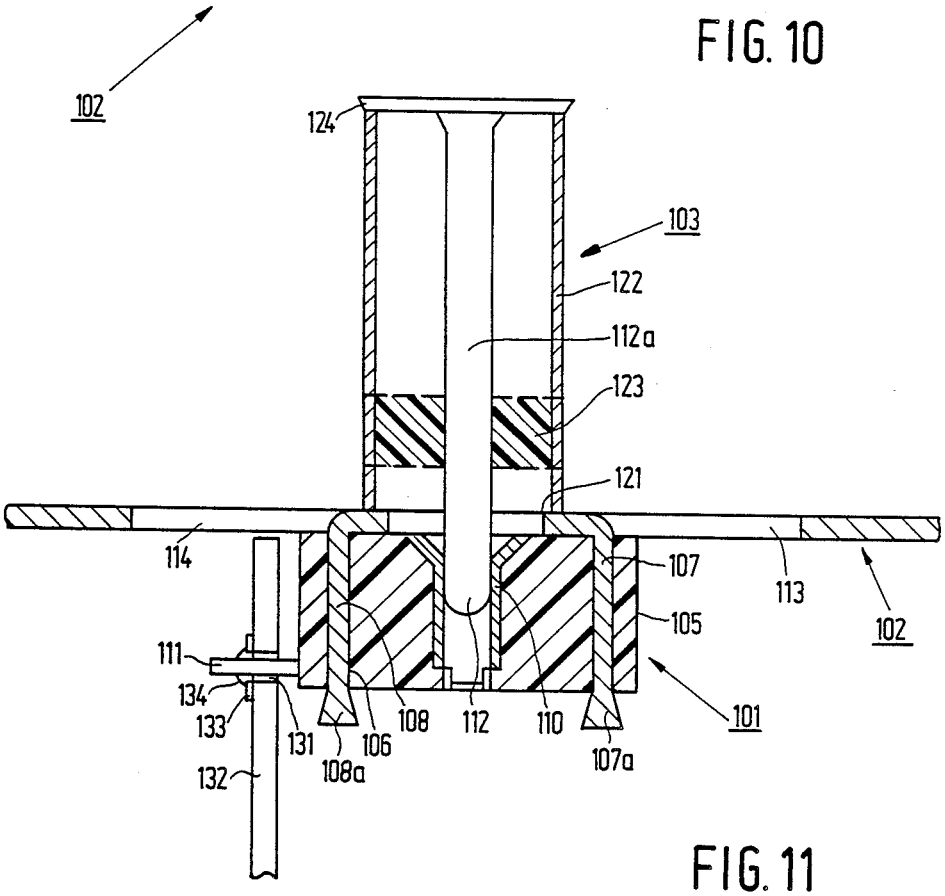
FIG. 11 shows the arrangement of FIG. 9 with a connection base clamped onto the housing wall and a fitted contact portion as well as a circuit board accommodated within the function unit.

FIG. 9 is an exploded sectional view of a connection base 101, a housing wall 102 and a contact portion 103 which are shown in the ultimate mounted condition in FIG. 11. The connection base 101 comprises an approximately square body 104 in which two oppositely situated, approximately rectangular recesses 105 and 106 are formed. The recesses 105 and 106 serve to accommodate two twist lugs 107 and 108 of the housing wall 102 (also shown in FIG. 9) at a later stage. At its center the connection base 101 comprises an electrically conductive sleeve 110 which is connected to a connection terminal 111 which emerges from one side of the connection base. The sleeve 110 is constructed so as to be hollow and serves to contact a connection pin 112 of the contact portion 103 which is also shown in FIG. 9. The electrical connection terminal 111 of the connection base 101 serves to make electrical contact with a circuit arrangement accommodated in the functional unit (not shown in the Figure). Except for the sleeve 110 and the connection terminal 11, the connection base 101 is made of an insulating plastic.

The twist lugs 107 and 108 are bent from the housing wall 102 which is shown in a sectional view in FIG. 9, so that recesses 113 and 114 are formed in the wall, and extend perpendicularly from the housing wall towards the interior of the housing. The recess 113 and the twist lug 107 on the one side and the recess 114 and the twist lug 108 on the other side are oppositely situated on both sides of a hole 115. In the ultimate, assembled condition the hole 115 serves for the passage of the connection pin 112 of the contact portion 103 so that its diameter is slightly larger than the diameter of said pin.

Figure 10:
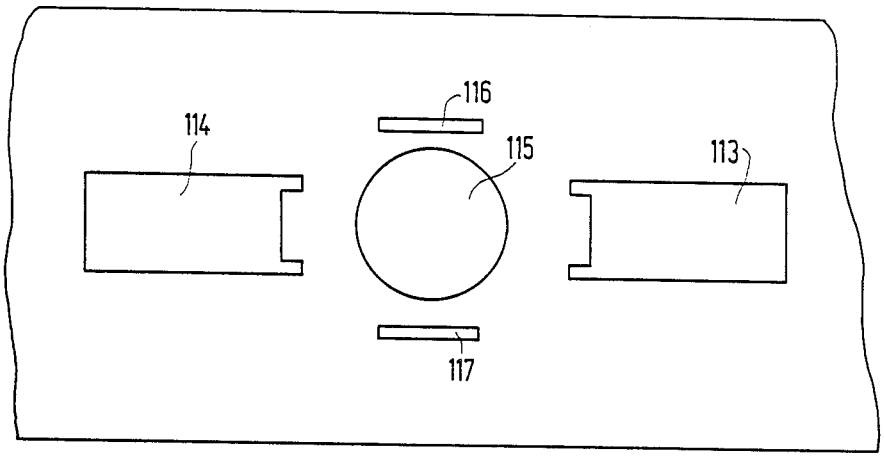
FIG. 10 is a plan view of the housing wall of FIG. 9, viewed on the side where the contact portion is fitted.

FIG. 10 is a plan view of the housing wall 102 of FIG. 9, viewed on the mounting side of the contact portion. This Figure shows rectangular recesses 113, 114 which are formed by bending out the twist lugs 107 and 108 which are not shown in FIG. 10. Between the recesses 113 and 114 the circular hole 115 is shown. Two further recesses 116 and 117 which are rotated through 90° with respect to the recesses 113 and 114, respectively, are oppositely situated on both sides of the hole 115. The recesses 116 and 117 have an elongate, narrow rectangular shape.

The recesses 116 and 117 in the housing wall 102 in FIG. 10 serve to accommodate twist lugs 120 of the contact portion 103 shown in FIG. 9. The twist lugs 120 are formed on one edge 121 of a metal tubular sleeve 122 which is the main constituent of the contact portion 103. In the ultimate, mounted condition, the contact portion 103 is fitted on the housing wall 102 by way of the edge 121 of the sleeve 122, so that the twist lugs 120 of the contact portion 103 engage the recesses 116 and 117 in the housing wall 102. The contact portion which is shown in a sectional view in FIG. 9 comprises an insulating plate 123 at the area of the edge 122. Through the center of this insulating plate 123 there is passed a conductor **112*a* which terminates as a connection pin 112 at the area of the edge 121 of the sleeve 122. The conductor 112*a*, the connector pin 112 and the sleeve 122 form one portion of a second embodiment of a feed-through connector consisting of two portions. The other portion is formed by the connection base 101. The conductor 112*a* terminates at the level of a free edge 124 of the contact portion 103. The shape of this edge and of the conductor 112*a*** are determined by a desired connection standard of a connector which can be connected to the functional unit and which is not shown in the figure, for example an aerial plug.

The contact portion 103 and the connection base 101, which are separately shown in FIG. 9, are shown in the mounted condition on the housing wall 102 in FIG. 11. The twist lugs 107 and 108 of the housing wall 102 now extend through the recesses 105 and 106 of the connection base and their ends **107*a* and 108*a* are twisted for mechanically securing the connection base to the housing wall. The connection base 101 is arranged inside a housing which comprises the housing wall 102. The connection pin 112 of the contact portion 103 is inserted from the outside into the sleeve 110 of the connection base so that it makes contact. The connection terminal 111, connected to the sleeve 110, is passed through a hole 131 in a printed circuit board 132. The printed circuit board 132 extends perpendicularly with respect to the housing wall 102 at such a distance from the connection base 101 that the electrical connection terminal 111 extends through the hole 131 in the circuit board 132. The connection terminal 111 is soldered (134) to a flat track 133 of the circuit board 132**.

The twist lugs 120 of the contact portion 103 are passed through the recesses 116 and 117 in the housing wall 102 in a manner not shown. The edge 121 of the contact portion 103 bears on the housing wall 102.

Thus, two electrical connections are established by means of the contact portion 103 and the connection base 101. One electrical connection extends via the conductor **112*a* and the connection pin 112 to the sleeve 110 of the connection base 101. The sleeve 110 itself is connected to the connection terminal 111 which itself is connected to the track 133 on the circuit board 132. The second electrical connection extends via the edge 124 of the outer, metal sleeve 122 of the contact portion 103 to the housing wall 102. This is the ground connection. In the condition shown in FIG. 11, the RF connection is operational. The edge 121 of the metal sleeve 122 of the contact portion 103 is soldered to the housing wall 102** in order to improve the ground contact.

The embodiments of the connection base which are shown in the Figures for fitting from the outside and the inside will already be fitted during manufacture of the functional unit. However, such a functional unit does not yet have the standard connector. The functional unit will be provided with a contact portion in compliance with the desired standard only when the type of desired standard connection is known, for example when the unit is built into an apparatus. It will be apparent that it is also possible to fit the contact portion already when the functional unit is manufactured. Furthermore, an already fitted contact portion can be removed again in order to be replaced by a contact portion in compliance with a different connection standard.

What is claimed is:

1. A feed-through connection arrangement for an RF-shielded unit, comprising an RF-shielding housing having an opening formed therethrough, a connection base fitted in said opening and secured to the housing, said base comprising an insulating member and a signal conductor extending through said member, said signal conductor being free from contact with said housing, and a contact portion comprising a connection pin and a grounded sleeve, said pin and sleeve each having a first end arranged for electrical connection respectively with said signal conductor and said housing, said connection pin being fixed with respect to and electrically insulated from said sleeve, and said connection pin and sleeve being arranged for engagement by a selected standard configuration plug for establishing electrical connection from respective mutually insulated parts of said plug via said connection pin and sleeve to said signal conductor and said housing respectively.

2. An arrangement as claimed in claim 1 comprising a ring clamped onto said grounded sleeve, said ring having an edge facing the housing, said edge having teeth, and wherein said housing comprises corresponding counterparts engaged by said teeth.

3. An arrangement as claimed in claim 1 characterized in that said insulating member is formed with a plurality of recesses, and said housing comprises a plurality of lugs projecting therefrom, each lug engaging a respective recess for securing the insulating member to the housing.

4. An arrangement as claimed in claim 3, characterized in that said housing has a plurality of recesses formed therein, and said grounded sleeve extends over said connection base and comprises a plurality of twist lugs engaging said recesses in the housing.

5. An arrangement as claimed in claim 2, comprising a ring clamped onto said grounded sleeve, said ring having an edge facing the housing, said edge having teeth, and wherein said housing comprises corresponding counterparts engaged by said teeth.

6. An arrangement as claimed in claim 1, characterized in that said housing has a plurality of recesses formed therein, and said grounded sleeve extends over said connection base and comprises a plurality of twist lugs engaging said recesses in the housing.

7. An arrangement as claimed in claim 6, comprising a ring clamped onto said grounded sleeve, said ring having an edge facing the housing, said edge having teeth, and wherein said housing comprises corresponding counterparts engaged by said teeth.

* * * * *